United States Patent [19]

Trevarrow

[11] 4,391,120

[45] Jul. 5, 1983

[54] RADIAL DEFORMATION MEANS FOR CYLINDRICAL OBJECTS SUCH AS WHEELS

[76] Inventor: David Trevarrow, 119 Reiniche, Horton, Mich. 49246

[21] Appl. No.: 19,683

[22] Filed: Mar. 12, 1979

[51] Int. Cl.[3] ..... B21D 53/26

[52] U.S. Cl. ..... 72/403; 29/159.1; 72/402

[58] Field of Search ..... 72/402, 403, 396; 29/159.1, 159.01; 269/57, 285, 289 MR

[56] References Cited

U.S. PATENT DOCUMENTS

| | | | |
|---|---|---|---|
| 1,102,818 | 7/1914 | Tassey | 72/402 |
| 2,428,419 | 10/1947 | Green | 72/402 |
| 3,222,912 | 12/1965 | Specht | 72/402 |
| 3,266,296 | 8/1966 | Hall | 29/159.1 |
| 3,276,239 | 10/1966 | Achler | 72/465 |
| 3,688,373 | 9/1972 | Gregg | 29/159.01 |
| 3,829,076 | 8/1974 | Sofy | 269/57 |
| 4,143,449 | 3/1979 | Main | 29/159.1 |

FOREIGN PATENT DOCUMENTS

| | | | |
|---|---|---|---|
| 639045 | 6/1950 | United Kingdom | 29/159.1 |

*Primary Examiner*—Gene Crosby

*Attorney, Agent, or Firm*—Ralph J. Skinkiss; William P. Hickey

[57] ABSTRACT

A radial truing device is disclosed having two sets of parallel jaws that are spaced apart to engage the opposite bead seats of a wheel, and the like. The jaws comprise radially extending slides, and each set of jaws is actuated by a separate ring, which rotates to move overcenter devices to an inline position to move the jaws radially inwardly. The overcenter devices bear against one half of a ring, and an antifriction bearing capable of absorbing radial and lateral movement is positioned between the other half of the ring and the frame. In the preferred embodiment, the overcenter devices are toggles that are connected to the jaws and to the rings by pins, and the bearings are generally in line with the connection of the overcenter device and the ring, so that the overcenter devices run true. The rings are actuated separately so that a lateral working of the wheel can be provided and so that a sequential deformation of the wheel is accomplished by forces exerted over a greater period of time than is possible by the prior art. In addition, a radially shiftable table having a resilient surface is provided which will accommodate the complex movement of the workpiece that is produced by the two sets of jaws.

20 Claims, 9 Drawing Figures

RADIAL DEFORMATION MEANS FOR CYLINDRICAL OBJECTS SUCH AS WHEELS

BACKGROUND OF THE INVENTION

The present invention relates to a new and improved device for deforming cylindrical objects such as the rim of a wheel, two or more cylindrical bands are deformed sequentially to better work the metal and move it in a more precise and permanent relationship to the axis of rotation.

With respect to wheels, the prior art has utilized a single set of radially movable jaws that bear against the entire rim to deform all areas of the rim simultaneously. The dies used to deform the complete rim build up tremendous stresses in both the actuating mechanism and the rim; and the prior art utilizes large cams to develop the necessary jaw actuating forces.

I have discovered that advantages can be had when two sets of jaws are provided which can be actuated sequentially. In some instances, the deformation of one side of the rim may tend to bow the opposite side outwardly while the first side is being deformed. By utilizing overcenter devices to actuate the jaws which do the deforming, the jaws can be adjusted to be in the desired position when the devices are in top dead center. In addition, the overcenter devices automatically provide an increasing mechanical advantage as the deformation progresses. Preferably, the overcenter devices are in their inline position at the time that the rim is deformed to specifications, and a locking action is provided by holding them in line. By bringing one side of the rim to specification before deforming the other side, the other side may tend to rock outwardly before engaged by its set of jaws. The second set of jaws then deform the metal through a greater distance than would otherwise occur, and a better set occurs in the metal.

According to further aspects of the invention, a new and improved support table is provided which will support a workpiece placed in an approximate position where it can be engaged by the jaws and to thereafter allow the jaws to center the workpiece unopposed so that an unbalanced deformation of the wheel is not produced due to restraining forces of the support table. In addition, a resilient surfacing material is provided which will accommodate lateral movement into the table if such becomes necessary for the jaws to properly true the wheel.

Accordingly, one object of the invention is the provision of a new and improved radial truing device for cylindrical workpieces such as the rims of wheels and the like which truing device has at least two sets of jaws that are arranged side by side and which can sequentially deform adjacent areas of the workpieces.

Another object of the present invention is the provision of a new and improved device of the above described type in which the actuation of the jaws is accomplished by separate rings with overcenter devices positioned between the respective ring and its jaws, and which are constructed and arranged to move toward an overcenter position as the deformation of the workpiece progresses.

Another object of the present invention is the provision of a new and improved workpiece support table for use in conjunction with the jaws and which is constructed and arranged so that a workpiece can be placed thereon in an approximate position and which will allow the jaws to automatically center the workpiece without imparting restraining forces which will cause the deformation to be out of specification.

Further objects and advantages of the invention will become apparent to those skilled in the art to which the invention relates from the following description of the preferred embodiments described with reference to the accompanying drawings forming a part of this specification.

DESCRIPTION OF THE PREFERRED EMBODIMENTS

Figure 1:
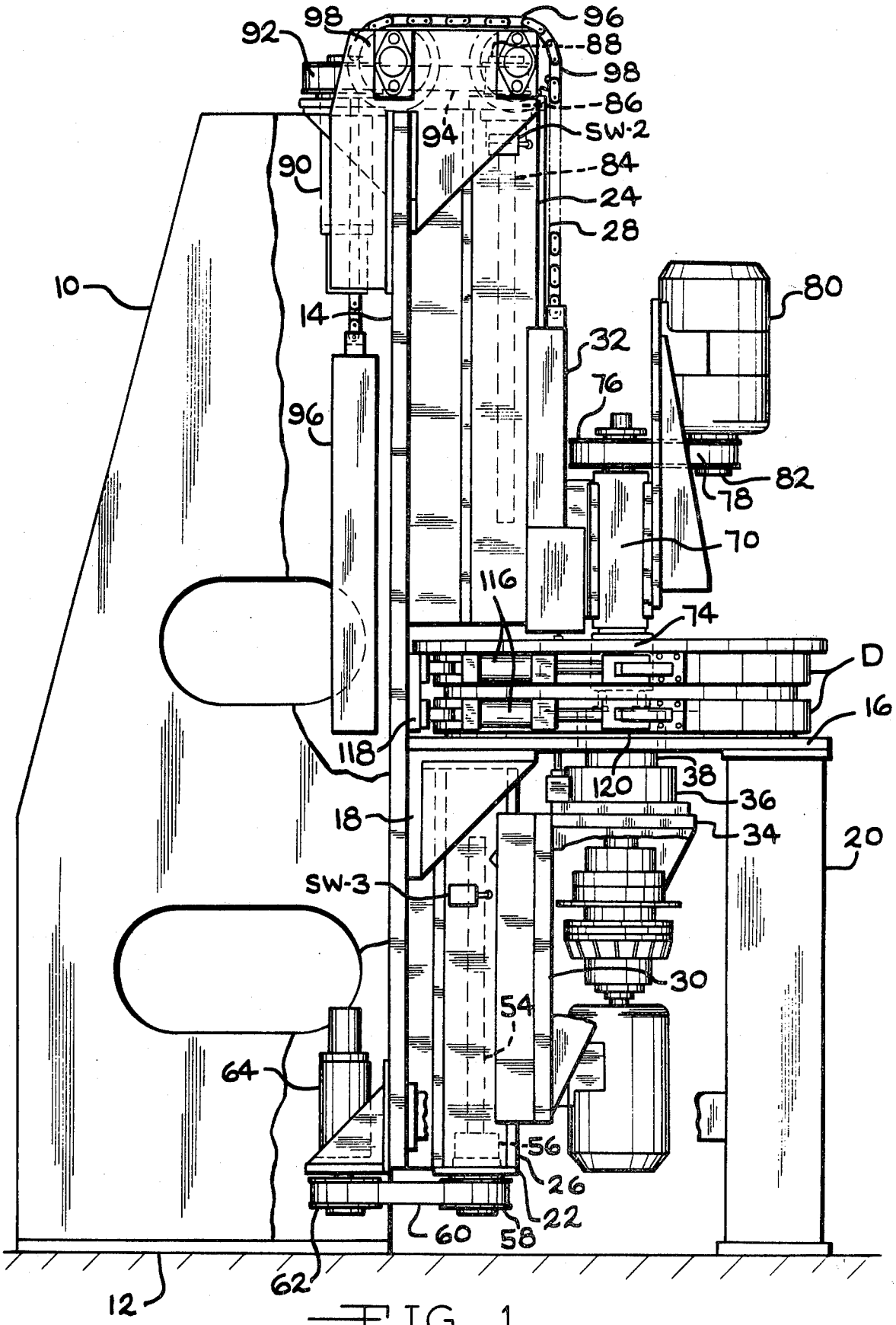
FIG. 1 is a side elevational view of apparatus which is constructed and which operates according to principles of the present invention.
Figure 2:
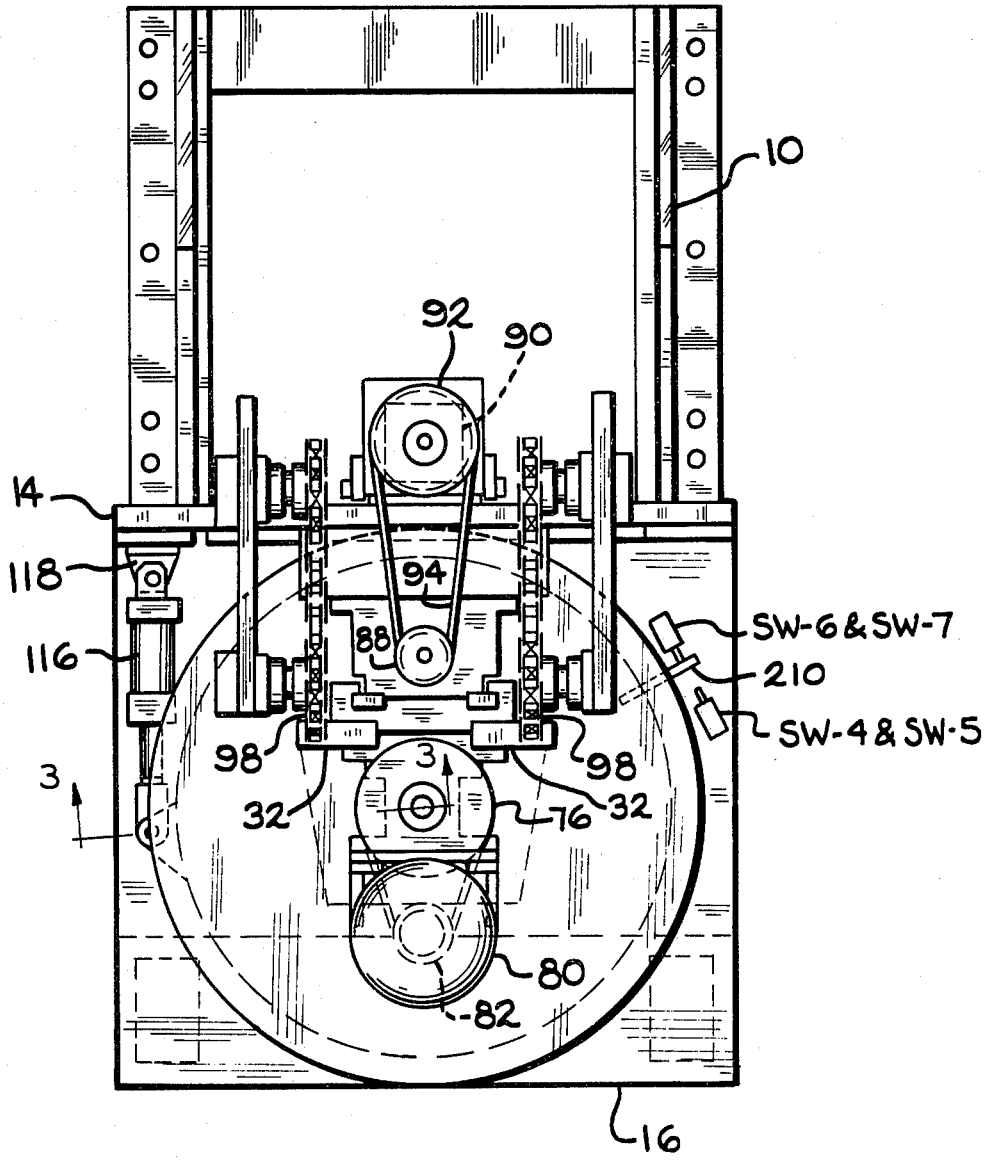
FIG. 2 is a plan view of the apparatus shown in FIG. 1.
Figures 6, 7:
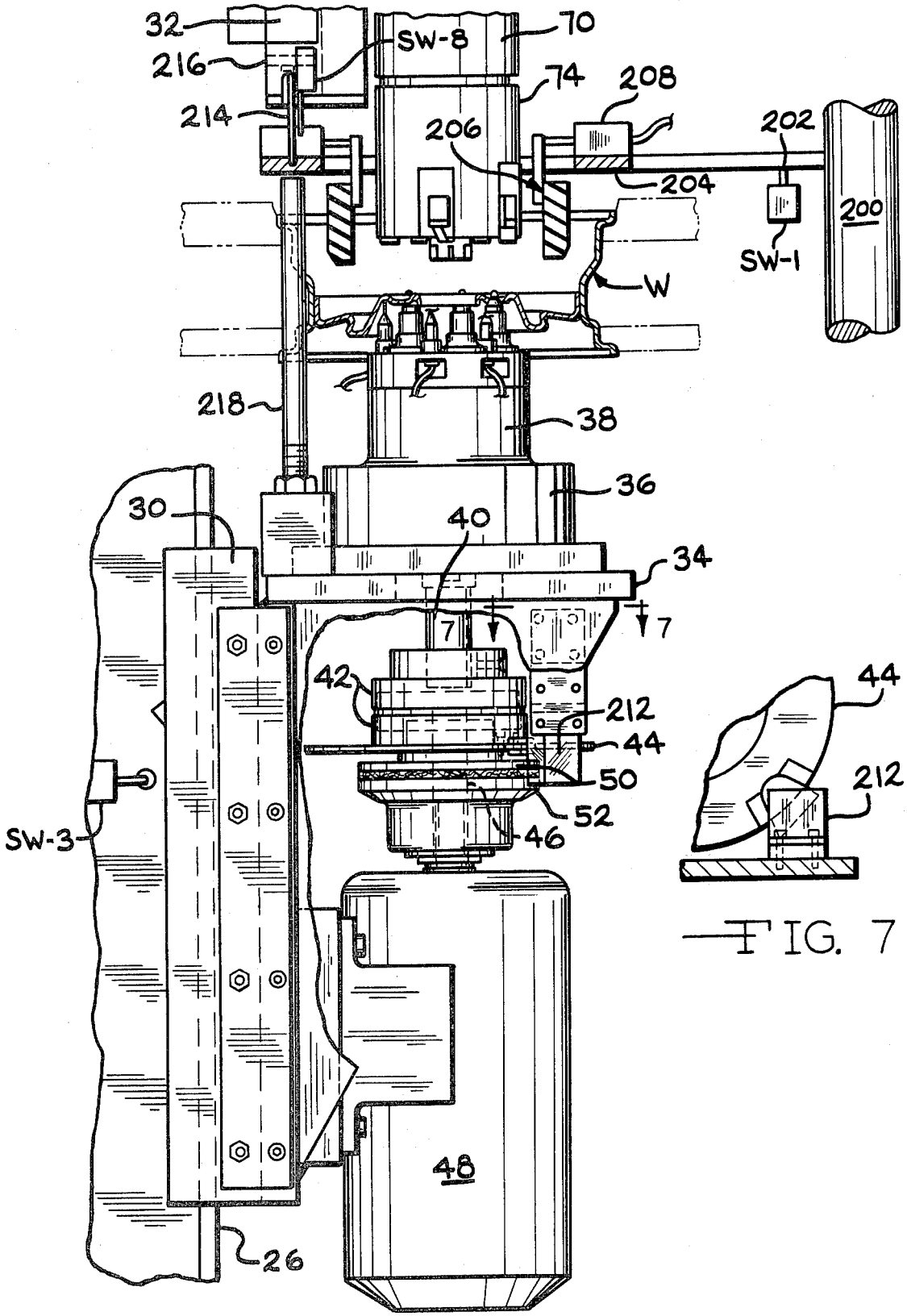
FIG. 6 is an enlarged fragmentary side elevational view, with portions broken away, and showing a wheel being worked upon by the apparatus.
FIG. 7 is a fragmentary sectional view taken approximately on the line 7—7 of FIG. 6.
Figure 8:
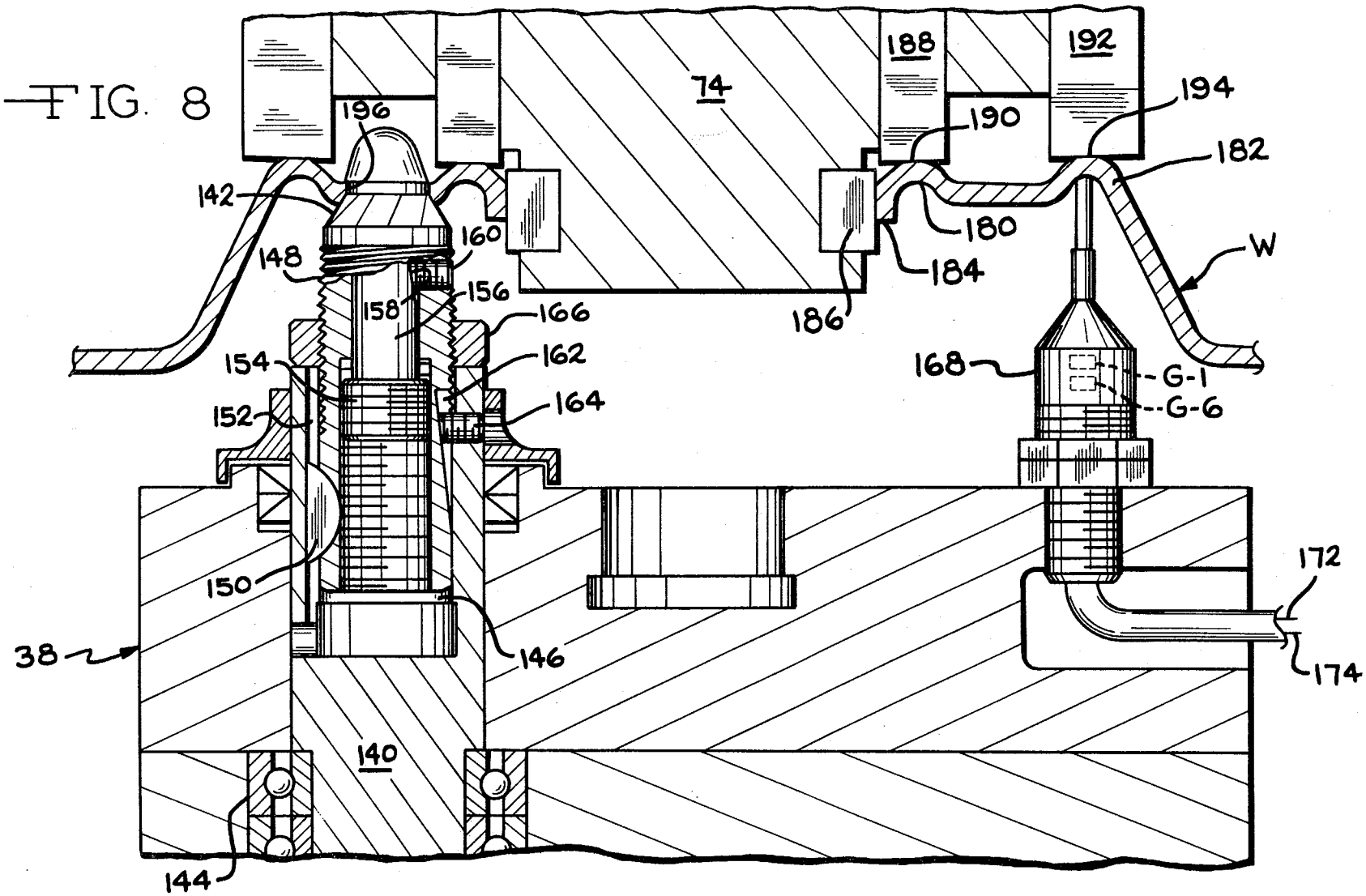
FIG. 8 is a greatly enlarged view of a wheel being machined by the top and bottom machining heads shown in FIG. 6.

As best seen in FIGS. 1, 2 and 6, the apparatus of the present invention generally comprises an upright frame 10 that stands upon a base plate 12, and which is faced with a vertical plate 14 to which components of the machine are bolted. A work station frame 16 is provided approximately half way up the facing plate 14. The inner end of the frame 16 is bolted to the facing plate 14 by means of a pair of angular brackets 18, while the outer ends of the work station frame 16 are supported by a pair of pedestals 20. The work station frame 16 in turn supports wheel deforming dies D, which will later be described in detail. A bolt-on way-frame 22 is secured to the facing plate 14 beneath the work station frame 16, and another bolt-on way-frame 24 is fastened to the facing plate 14 above the work station frame 16. The bolt-on way-frames 22 and 24 carry way surfaces 26 and 28, respectively, which are carefully aligned at right angles to the work station frame 16.

A lower slide 30 is hung off of the lower way surfaces 26 for movement toward and away from the bottom surfaces of the work station D, and an upper slide 32 is hung off of the way surfaces 28 for movement toward and away from the upper surface of the work station D. A horizontal bearing plate 34 is suitably affixed to the upper end of the lower slide 30, and the bearing plate 34 in turn supports a bearing housing 36 for a multiple spindle machining head 38 that projects from its upper end. A centrally located drive shaft 40 for the head 38 extends out of the bottom of the bearing housing 36, through an opening in the bearing plate 34, into the top half of an alignment coupling 42. The bottom half of the alignment coupling 42 is secured to the top of a brake disc 44 and the two are suitably journaled about the projecting end of the shaft 46 of an induction drive motor 48. The top plate 50 of a friction clutch is secured to the bottom of the brake disc 44, and the bottom plate 52 of the friction clutch is nonrotatably secured to the motor shaft 46 by a suitable keyway.

The lower slide 30 is moved upwardly toward the work station D and downwardly away from the work station D by means of a ball lead screw 54 that is suitably received in the structure of the lower slide 30, and the shaft of which projects through bearing structure 56 that is fixed to the bottom of the lower way frame 22. The bottom of the shaft of the ball lead screw 54 is fixed to a cleat pulley 58 that is driven by a nonslip cleat belt 60. The cleat belt 60 is in turn driven by a similar pulley 62 that is affixed to the shaft of a vertically oriented servo drive motor 64 that is supported on the back side of the facing plate 14. The servo drive motor 64 is adapted to move the lower slide 30 upwardly at two different speeds, and to stop the lower slide 30 at a precise relative position to a wheel in the work station D, as will later be explained in detail.

The upper slide 32 is arranged for movement parallel to the bottom slide and carries a tubular spindle housing which journals a single spindle 72, the lower projecting end of which carries the upper machining head 74. The spindle 72 is driven by a belt pulley 76 that is in turn driven by a drive belt 78. An induction motor 80 is supported by the spindle housing 70 parallel to the spindle 72 and drives the belt 78 by means of a drive pulley 82.

The upper slide 72 is arranged to be withdrawn a considerable distance above the work station D in order that wheels can be loaded into and unloaded out of the top of the work station D. To facilitate loading and unloading, the slide 32 is provided with drive mechanism which provides a fast advance and retraction, a fast feed downwardly, followed by a slow feed downwardly. Slide 32 is driven by a vertical ball lead screw 84, the lower end of which engages structure of the slide 32. The upper end of the shaft of the lead screw 84 extends through a bearing housing 86 fixed to the upper end of the way frame 24, and is driven by a cleat pulley 88. Cleat pulley 88 is in turn driven by a servo drive motor 90 whose shaft projects up from the upper end of the frame 10 and carries the drive cleat pulley 92. Cleat pulleys 86 and 92 are opposite each other, and are connected by a nonslip cleat belt 94. In order to aid the precision with which the servo drive motor 90 can position the upper slide, particularly during rapid advance, the slide 32 is counterbalanced by a weight 96, which is positioned on the back side of the facing plate 14, and which is connected to the slide by a pair of roller chains 96. The roller chains pass over sprockets 98 that are suitably supported on the upper end of the frame of the machine. The upper slide 32 of the machining head is shown in its lowermost machining position in FIGS. 1 and 6 of the drawings; and it will be understood that the slide 32 and machining head 74 will be adjacent the top of the frame of the machine during loading and unloading of wheels into the work station D.

Figure 3:
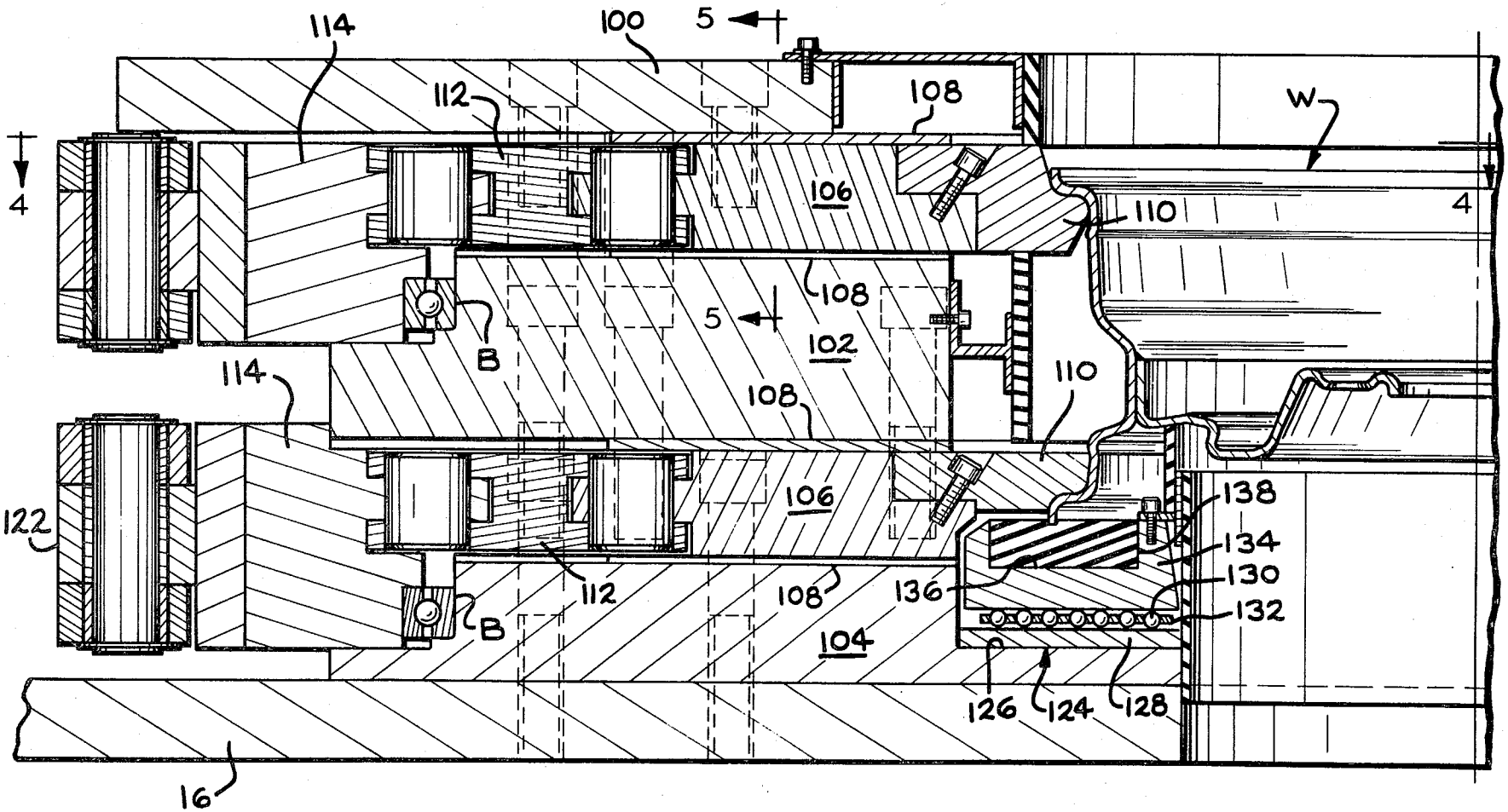
FIG. 3 is a fragmentary enlarged sectional view taken approximately on the line 3—3 of FIG. 2.
Figure 4:
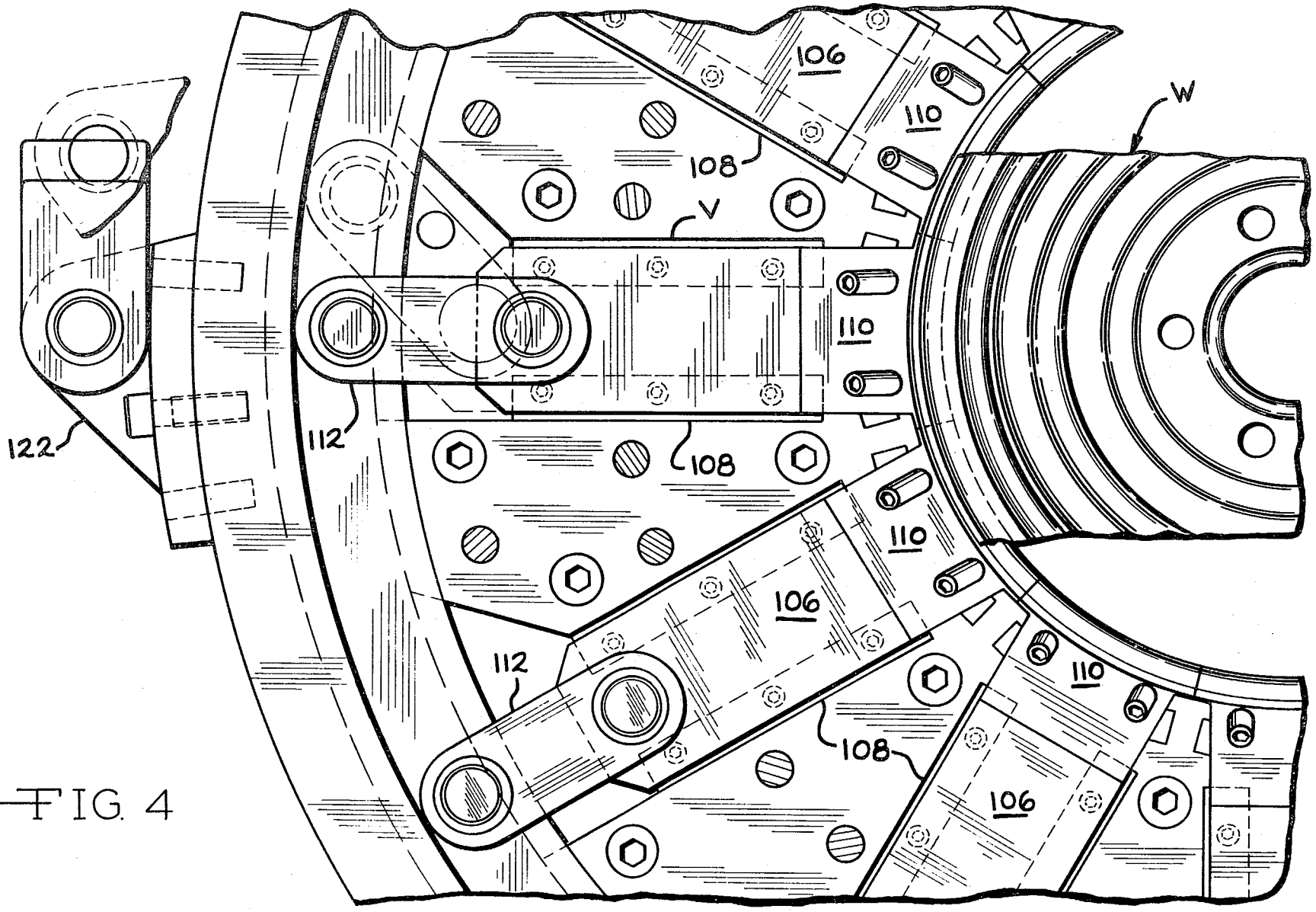
FIG. 4 is an enlarged fragmentary sectional view taken approximately on the line 4—4 of FIG. 3.
Figure 5:
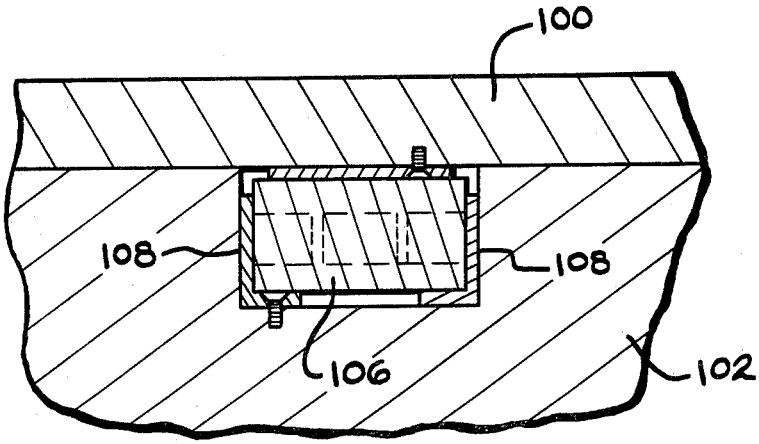
FIG. 5 is a fragmentary sectional view taken approximately on the line 5—5 of FIG. 3.

In the apparatus shown in the drawings, a rim shrinking die assembly D is located at the work station D, and is fastened to the top surface of the working station frame 16 precisely concentric with the axis of rotation of the lower machining head 38 and the upper machining head 74. The die assembly D is generally a self-contained unit comprising: upper, middle and lower die plates 100, 102 and 104, respectively, that are suitably contoured and bolted together to provide support for a plurality of radially extending master jaw slides 106, and their L-shaped brass guide plates 108. The L-shaped die plates 108 are suitably fixed to the upper, middle and lower die plates 100, 102, and 104, as the case may be, by suitable fasteners, not numbered. The inner ends of the jaw slides 106 are provided with hardened jaw tips 110 that are suitably shaped to abut the bead surfaces of the rim of an automotive vehicle and deform the bead surfaces radially inwardly. The outer end of the jaw slides 106 have toggles 112 suitably pinned thereto, and the outer end of the toggles 112 are suitably pinned to an appropriate one of a pair of actuating rings 114 which extend 360 degrees around the outside of the jaw slides 106. The lower actuating ring 114 is journaled to the outside of the lower die plate 104 by an antifriction bearing B comprising inner and outer raceways and a plurality of balls; and the upper actuating ring 114 is journaled to the middle die plate 102 in a like manner by an identical friction bearing B. The actuating rings 114 are adapted to be rotated approximately ten degrees by respective upper and lower hydraulic actuating cylinders 116 that are best seen in FIGS. 1 and 2. The cylinder end of the actuating cylinders 116 are suitably pinned to the facing plate 14 by suitable bifurcated brackets 118, and the piston rods of the actuating cylinders 116 are provided with bifurcated fittings 120 that are pinned to ears 122 that are welded to the appropriate actuating ring 114. Expanding the hydraulic cylinders 116 causes the actuating rings to move the toggles 112 from the dot-dash position shown in FIG. 4 to the solid position shown in FIG. 4, and in turn move the jaws 106 from their radially outer positions to the irradially inner positions shown in FIGS. 3 and 4 of the drawings.

As previously indicated, wheels to be trued are fed to the apparatus shown in the drawing when the upper slide 32, and upper machining head 74 which it carries, are moved to the upper end of the frame free and clear of the work station D. The wheels are fed by a conveyor and work transfer means to a position over the work station D and are lowered into position so that the bead seats of the wheels rim is opposite the jaws 110. According to principles of the present invention, the wheel is supported in the appropriate position opposite the jaws 110 by a work support table 124 of unique construction and which is about to be described. As shown in the drawings, the work support table 124 is an annular table on which the lower rim of the wheel sets when the bead seats of the rim are opposite the jaws 110. In the present instance, the work support table 124 is supported in an annular recess 126 in the lower die plate 104. An annular bottom support plate 128 fits into the recess 126, and a plurality of identically shaped balls 130 are held by a cage plate 132 in spaced apart positions extending around the top surface of the plate 128, for the support of a thick annular surface plate 134. The surface plate 134 contains an annular groove 136 in the area beneath the innermost travel of the jaws 110, and an annular hard rubber surfacing disc 138 is positioned in the groove 136 for the support of the edge of the rim of the wheel being worked upon. The rubber surfacing disc 138 is of a thickness and resiliency which will accommodate lateral deflection of the edge of the rim as occurs when the opposing jaws 110 deform the bead seats of the rim radially inwardly. In addition, the rubber surfacing material 138 is of a lubricious nature which permits the edge of the rim to shift laterally during the time that the rim is being deformed radially inwardly. In addition, the whole surfacing plate 134 can move laterally over the top of the balls 130 to center the rim prior to its deformation by the jaws, should this be necessary to equalize forces around the rim. It will be seen that the work support table 124, therefore, will support the wheel in an approximate position, so that it can be caught by the jaws 110 and the table shifted laterally to provide an initial centering action. Thereafter the table permits the rim of the wheel to be pushed down into its resilient surface by whatever amount is necessary to accommodate the deflection of the rim as it is being deformed radially inwardly to the proper bead seat diameter.

Figure 9:
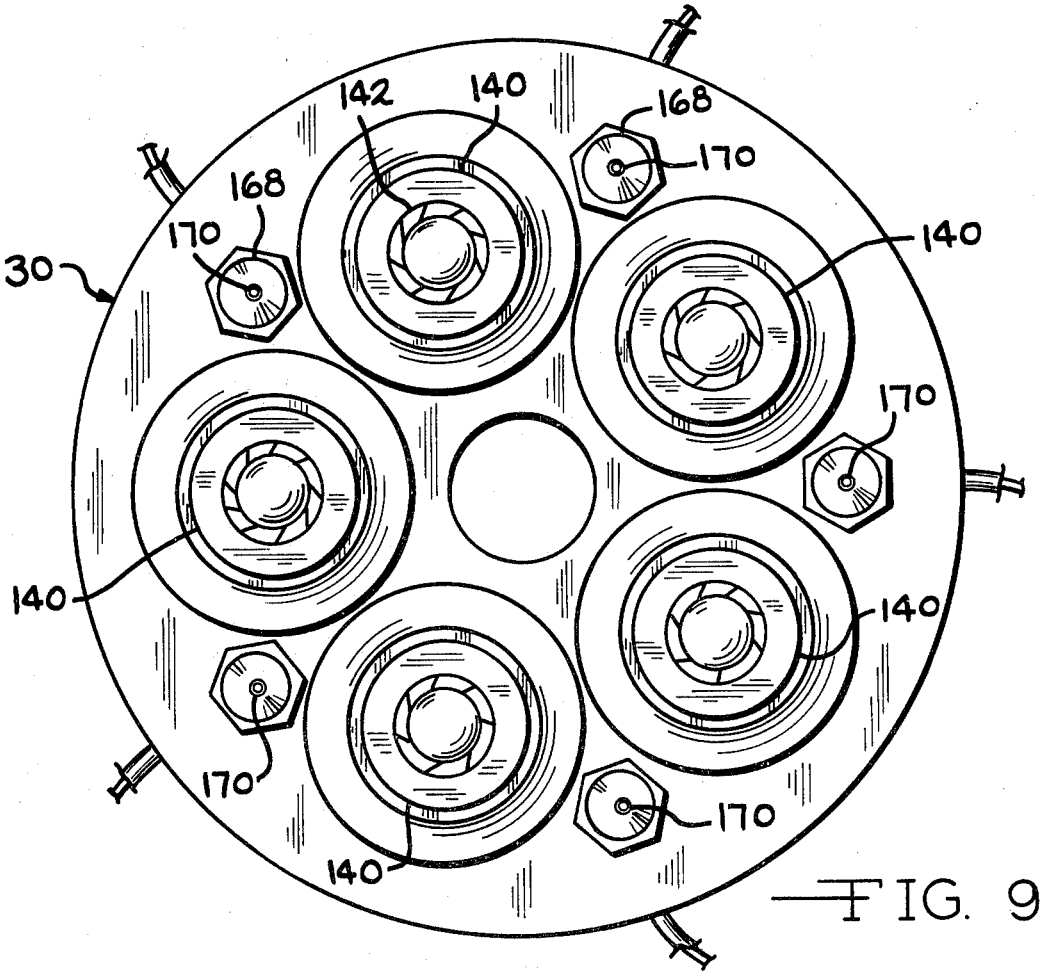
FIG. 9 is a plan view of the bottom machining head.

After the rim deforming dies have trued the bead seats, the lower slide 30 and multiple spindle machining head 38 which it carries, moves up against the bottom surface of the web of the wheel to chamfer the lug holes by which it will be fastened onto the hub of the axle of an automotive vehicle. In the embodiments shown in the drawings, and as best seen in FIG. 9, the multiple spindle machine head 38 being described has five spindles 140 each of which carries a conical cutter 142 appropriately tapered to chamfer the lug holes of the web of the wheel. Each of the spindles 114 are journaled by antifriction bearings 144, and are rotated by suitable gearing (not shown) that in turn is driven by the drive shaft 40. Spindle 140 is bored out at its upper end, as at 146, to receive a tubular tool holder 148. The lower end of the tubular tool holder 148 has a woodruff key 150 lodged therein, which in turn slides in a keyway 152 that extends longitudinally of the inner wall of the spindle 140. The lower end of the tool holder is counterbored and threaded to receive a set screw 154 that is adjustable against the bottom end of the shank 156 of the cutter 142. The shank 156 has a wedge shaped groove 158 longitudinally thereof, into which a set screw 160 is tightened to hold the cutter 142 down into engagement with the set screw 154. The tool holder 148 in turn has a wedge shaped groove 162 into which a set screw 164 is tightened to lock the tool holder to the spindle. In addition, the upper end of the tool holder 148 is threaded, and a threaded lock nut 166 is tightened down onto the end of the spindle 140 to lock the tool holder in place.

The lower multiple spindle head 38 also carries a plurality of gauging switches spaced evenly around the head beneath the outer annular bolting surface of the web that is to be machined by the top slide, as will later be described. The gauging switches 168 are precisioned instruments and have contact pins 170 that extend down into the body of the switches to sequentially open a first switch and then close a second switch after approximately 0.0030 inch of travel. The first switch controls the energization of wire 172 and the second switch controls the energization of wire 174.

The inner face of the wheels being trued are stamped with inner and outer concentric rings 180 and 182, respectively, and an outwardly bent tubular portion 184 for bearing contact with the axle hub of the automotive vehicle on which it is to be installed. The upper head 74 contains a set of concentric cutters 186 suitably held for feeding axially through the tubular portion 184 to give it a cylindrical machined surface for gripping the hub. The head 74 also contains another set of spaced apart milling cutters 188, the bottom ends of which are beveled at approximately a three degree angle to the horizontal for milling a flat bolting surface 190 on the inner surface of the ring 180. The head 74 is provided with another set of milling cutters 192, the end surfaces of which are also tapered at a three degree angle for milling a bolting surface on the inner ring 182. The cutters 188 and 192 have their cutting surfaces aligned so that their revolution defines the surface of a flat cone which forms an angle of 93 degrees with the cylindrical surface that is machined on the tubular portion 184 by the cutters 186. The metal between the bolting surfaces 190 and 194, and which contain the lug holes 196, is bent outwardly at approximately a 45 degree angle. The cutters 142 are beveled at approximately a 60 degree angle so that a lug that is tapered at approximately a 45 degree angle will put the metal between the lug and the holding surfaces 190 and 194 in direct compression. When the wheel is abutting a radial surface, the web is bent at a point outwardly of the outer bolting surface 194 enough to cause the bolting surfaces 194 and 190 to become planar against the radial surface of the hub on which the wheel is being bolted. The surfaces 190 and 194 at this time will be flat against the radial surface, with their full machined surface in contact therewith to keep bearing stresses at a minimum. In addition, the deflection of the center portion of the web as above described will cause the outer end of the tubular portion 184 to be shrunk radially inwardly to tightly grip and center the web on the cylindrical portion of the hub of the axle on which the wheel is being bolted. It will further be seen that the apparatus of the present invention causes the bolting surfaces 190 and 194 to be absolutely true with respect to the plane passing through the trued bead seats, so that the bead seats run absolutely true with the axle of the vehicle.

It has been found that the wheels of the present invention have greater service life than do wheels that are identically made, but which have not have the bolting surfaces 190 and 194 machined, even though the rims have been deformed radially concentric with the lug holes. The reasons why this is so are not fully known at this time, but it is believed that this fact shows that the angular misalignment of the bolting surfaces of the web with respect to the rim, causes the metal of the web to be fatigued by axially changing stresses as the tire rolls over paved surfaces, and that the present invention greatly reduces these stresses.

As previously indicated, the wheels are loaded and unloaded from the mechanism above described by a transfer mechanism which takes the wheels from a conveyor and loads it onto the work table. After the wheel is machined, the transfer mechanism moves the wheel up out of the dies, and then indexes to bring another wheel into position. This mechanism is shown schematically in FIG. 6. The mechanism comprises a vertical shaft that both rotates and moves vertically up and down, and a plurality of arms 202 which carry rings 204 that are to be centered over the work station. Each ring 204 has a plurality of levers 206 pivoted thereto. The bottom end of the levers 206 grip the rim of the wheel, and the upper end of the levers are moved in and out by air cylinders 208 to produce the gripping action. A switch SW-1 is shown schematically as positioned beneath the position of the arm 202 after it has loaded a wheel onto the supporting table 124, and when the switch SW-1 is actuated, it initiates the operation of the machine about to be described.

At the time that a wheel is lowered onto the work table 124, the upper slide 32 is in engagement with the switch SW-2 at the upper end of the frame, and the lower slide 30 is in engagement with the home position switch SW-3—in which position, the multiple spindle head 38 is just beneath the rim of the wheel resting on the table 124. The air cylinders 208 unclamp the wheel at the time SW-1 is actuated, and simultaneously therewith, the lower chuck actuating cylinder 116 is actuated to move a trip dog 210, carried by the lower chuck actuating ring 114, from the chuck retracted switch SW-4 into engagement with the chuck advanced switch SW-6. Shortly thereafter, the dog 210 on the top actuating ring 114 moves out of engagement with the chuck retracted switch SW-5, and into engagement with the chuck advanced switch SW-7. When both switches SW-6 and SW-7 are actuated, the servo motor 64 which actuates the bottom slide, and the servo motor 90 which actuates the top slide, become actuated. It will be understood that the drive motor 48 of the bottom machining head 38, and the drive motor 80 for the upper machining head 74 are rotating at this time since they operate continuously once the electrical system for the machine is energized. Shortly after the bottom slide starts upwardly, the cutters 142 start the countersinking of the various lug holes. Shortly after the countersinking starts, the contact pins 170 which are positioned beneath the cutting surfaces of the cutters 140 and 142 start to engage the web. As previously indicated, the contact pins 170 on initial contact with the web actuate a first switch contact therein (which will be designated G-1 through G-5 for each of the five gauging switches 168). Upward movement of the bottom slide will continue until such time as the second switch contact of the first gauge 168 is actuated. These contacts will be designated G-6 through G-10. If at the time that the first of the second switches contacts G-6 through G-10 are actuated, all of the switches G-1 through G-6 have been actuated, the web is deemed to be within angular tolerance, and the operation of the machine will continue as will later be described. If, however, all of the contacts G-1 through G-5 are not actuated at the time the first of the contacts G-6 through G-10 are actuated, the wheel is deemed to be defective, and the operation of the machine is interupted to retract the chucks and remove the wheel from the machine.

Assuming that the web is within angular tolerance, the servo motor 64 is caused to remain stationary, the clutch 42 for the lower spindles is deenergized, and a caliper brake 212 is actuated to clamp the brake disc 44 and stop rotation of the bottom spindles.

As previously indicated, the servo motor 90 for the top slide was actuated at the same time that the servo motor 64 for the bottom slide was actuated. The initial actuation of the servo motor 90 causes the top slide 32 to move downwardly at a fast advance speed until the actuating pin 214 of a gauge switch 216 carried by the top slide 32 is caused to engage an abutment rod 218 that is carried by the bottom slide 30. The abutment rod 218 is adjustable and sticks up vertically from the top surface of the bottom slide 30 through the work station D to be engaged by the actuating pin 214. Gauge switch 216 contains two contacts G-11 and G-12, the first of which is actuated upon immediate contact of the pin 214 with the rod 208 to stop the fast advance of the top slide 32, and start a fast feed movement for the slide which causes the axial cutters 186 to move through the tubular bent portion 184 of the wheel with a lateral machining feed. After the bottom edge of the cutters 186 have proceded past the bottom edge of the tubular portion 184, contact G-12 of the switch 216 is actuated to start a slow speed actuation of the servo motor 90 that causes the cutters 188 and 192 to move into end milling abutment with the concentric rings 180 and 182 of the rim to machine the concentric bolting surfaces 190 and 194.

While the machining of the bolting surfaces 190 and 194 is taking place, chamfer cutters 142 are held stationary and into tight engagement with the web of the wheel. During this time, servo motor 64 opposes any movement of its rotor out of its set position. After a further predetermined movement of approximately 0.010 inches of the slide, another switch SW-8 contacts the top surface of the post 218 to deenergize the top servo motor 90 and thereby limit the depth of cut of the bolting surfaces 190 and 194. A timer causes the drive 80 for the cutters to continue rotating for a brief period until the cutters clean up the surfaces 190 and 194. After the dwell timer times out, servo motors 64 and 90 are both reverse energized to retract the slides 30 and 32 simultaneously. Since the bottom slide 30 has the shortest distance to travel, it hits the home switch SW-3 shortly thereafter, and causes the bottom servo motor 64 to be deenergized.

At the same time that the servo motors 64 and 90 were reverse energized by the timer, both cylinders 116 were actuated for retraction to bring both dogs 110 into engagement with switches SW-4 and SW-5. After switches SW-4 and SW-5 are actuated, a suitable time delay is produced by a timer to allow the top slide 32 to move free and clear of the work station D. When the timer times out, it causes the air cylinders 208 to be actuated to grip the wheel and the vertical shaft 200 of the transfer mechanism to start upwardly. The shaft 200 then rotates to move the machined wheel away from the machine and bring a new wheel into position for lowering onto the work support table 124. By this time, the top slide 32 will have reached the top home position switch SW-2 to actuate the same. When the arm 202 of the transfer mechanism has moved downwardly to lower the wheel into proper position, it actuates the switch SW-1 and the cycle is repeated.

It will now be seen that the objects heretofore enumerated, as well as others, have been accomplished; and that there has been provided a new and improved device for truing cylindrical objects, such as the rims of wheels and the like. Whereas the prior art has used a single set of jaws which deform all surfaces of the rim simultaneously, the present invention utilizes at least two sets of jaws to affect a working of the metal that has not been possible heretofore. Where the invention is used to true the opposing tire bead seats of a wheel, one set of jaws is provided for deforming one bead seat adjacent one edge of the rim, and another set of jaws is provided for deforming the other bead seat adjacent the opposite side of the rim. In the preferred manner of operation, one set of these jaws is operated first to deform one bead seat to its desired dimension and to provide a metal set therein, before the other set of jaws deforms the opposite bead seat and deforms it to its desired dimension. Utilizing this procedure, the final set of the wheel is more accurate and better retained.

Also according to the invention, an improved mechanism is provided for moving the jaws. In the preferred embodiment, overcenter devices are interpositioned between a surrounding actuating ring and the radially sliding jaws to force the jaws radially inwardly as the overcenter devices are moved to their inline position. Such structure permits the jaws to be adjusted such that the desired deformation occurs in the inline position of the mechanisms. With such an arrangement, it is impossible to deform the workpieces to a greater extent than desired. Another advantage that such an arrangement has is that the mechanical advantage increases as the displacement of the jaws increases.

It will be understood that overcenter devices can be any type of compression member, one end of which is pushed by the ring, and the other end of which pushes the slide. In the most preferred arrangement, toggles are used, the opposite ends of which are pinned to the ring and slide, respectively. With the use of toggles, the jaws can be positively retracted; and as a matter of fact, can be used, when gripping jaws are provided, to expand the workpieces radially. In the preferred embodiment, the overcenter devices only utilize only half of the thickness of the ring; and the other half of the thickness of the ring is used to accommodate a bearing structure interpositioned between the ring and the frame. By this construction, twisting of the ring is minimized and a more beneficial balance of forces on the slide is provided. In the most preferred embodiment, the center of the bearing generally coincides with the center of the pivotable connection between the overcenter device and the ring. Most preferably, the bearing is an antifriction device capable of restraining both lateral and radial movement of the ring.

The workpieces must be placed inside of the jaws when they are retracted in a sufficiently accurate position with respect to the jaws that the jaws will properly pick up the rim and perform its deformation. According to another aspect of the invention, a work table is provided that does not restrain the deformation movement in any way. According to the invention, this is accomplished by an annular work support table that is positioned on rollers which allow the table to shift radially with substantially no restraint. In addition, the table is provided with a thickness of resilient material, as for example, a medium hard rubber, which will allow the jaws to spread the beads of the rim apart and force one of them down into the resilient material. The restraining action of the resilient material is not detrimental, since it only produces a lateral force on the jaws. In addition, the resilient material can accommodate some radial movement of the rim seated thereon. In the most preferred embodiment, the resilient material will be a thickness of silicone rubber over which the edge of the rim can slide.

While the invention has been described in considerable detail, I do not wish to be limited to the particular embodiments shown and described, and it is my intention to cover hereby all novel adaptations, modifications, and arrangements thereof which come within the practice of those skilled in the art to which the invention relates.

I claim:

1. Truing apparatus for wheels having a rim with opposing bead seats and a web, said apparatus comprising: radially inwardly moving concentric dies movable in a predetermined plane, a rigid support surface parallel to said predetermined plane, a plurality of rollers having the same diameter on said rigid support surface, an annular surface plate on said rollers free to move parallel to said rigid support surface, and a resilient surface on said annular surface plate, said resilient surface being arranged to support the rim of a wheel being worked open by said radially inwardly moving dies and being adapted to accommodate lateral deflection produced by said dies.

2. A table for supporting workpieces being deformed in a predetermined plane, said table comprising: a rigid support surface parallel to said predetermined plane, a plurality of rollers having the same diameter on said rigid support surface, a surface plate on said rollers free to move parallel to said rigid support surface and a resilient surface on said surface plate permitting the workpieces being deformed to move into said resilient surface.

3. The table of claim 2 wherein said surface plate has a recessed portion and said resilient surface is an elastomeric material in the recessed portion.

4. The table of claim 3 wherein said table is annular and including: means in the center of said annular table for performing work on the workpieces being deformed.

5. The table of claim 3 including radial deforming dies arranged to shrink the workpieces in said predetermined plane.

6. A device for truing a wheel blank having a rim with opposing tire bead seats, said device comprising: a frame, a first set of radially extending slides carried by said frame and having radially inner ends for abutment with one of the tire bead seats of a wheel positioned inwardly of said slides, a second set of radially extending slides carried by said frame and having radially inner ends for abutment with the other one of the tire bead seats of the wheel, a first ring positioned radially outwardly of said first set of slides, a second ring positioned radially outwardly of said second set of slides, overcenter means positioned between the respective slides of said first set of slides and said first ring, overcenter means positioned between the respective slides of said second set of slides and second ring, and means for turning said first and second rings independently of each other.

7. The device of claim 6 wherein each ring has a thickness greater than the slide which it actuates, and antifriction bearing means are positioned between each ring and the frame on the portion of the thickness of the ring that extends to the side of the slides which it actuates.

8. The device of claim 7 wherein said antifriction bearing means is generally in line with the connection between the ring and the overcenter means which it actuates.

9. The device of claim 8 wherein said overcenter means are toggles pinned to the rings and the slides which they operate.

10. A device for truing a generally cylindrically shaped workpiece, comprising: a frame, a first set of inwardly movable dies carried by said frame, a second set of inwardly movable dies carried by said frame, a first ring positioned outwardly of said first set of dies, a second ring positioned outwardly of said second set of dies, means causing said first and second rings to move respective first and second sets of dies inwardly independently of each other, and means actuating said rings in sequence, and whereby a workpiece positioned inwardly of said dies is centered and held by the first set of dies and the second set of dies finishes the deformation of the workpiece corresponding to the deformed surface established by the first set of dies.

11. The device of claim 10 including: first and second antifriction bearings accurately locating respective first and second rings from said frame, and whereby the workpiece is finish deformed to an accurate location with respect to said frame.

12. A device for truing a generally cylindrically shaped workpiece, comprising: a frame, a first set of inwardly movable dies carried by said frame, a second set of inwardly movable dies carried by said frame, said first and second sets of dies being movable in generally parallel planes, a first ring positioned outwardly of said first set of dies with one side portion of said ring being opposite said first set of dies and the other side portion being opposite said frame, a first antifriction bearing accurately positioning said other side of said first ring from said frame, a second ring positioned outwardly of said second set of dies with one side portion of said ring being opposite said second set of dies and the other side portion being opposite said frame, a second antifriction bearing accurately positioning said other side of said second ring from said frame, first and second sets of toggles with the first set connecting said first ring and first set of dies and with said second set of toggles connecting said second ring and second set of dies, said toggles being pinned to their rings on a circular centerline generally opposite the respective antifriction bearing, and means for rotating said first and second rings sequentially, and whereby a workpiece positioned inwardly of said dies is centered and held by the first set of dies accurately with respect to said frame, and the second set of dies finishes the deformation of the workpiece corresponding to the deformed surface established by the first set of dies.

13. The device of claim 12 including: a work support table positioned radially inwardly of said dies in position to support a workpiece to be worked upon by said dies, and antifriction means supporting said table to accommodate radial movement imported to the workpiece by said dies.

14. The device of claim 13 including resilient surfacing material carried by said table and on which the workpiece rests, said resilient material being constructed and arranged to accommodate lateral deflection of the workpiece as it is worked upon by said dies.

15. The device of claim 14 wherein the surface of said resilient material is positioned at a level opposite said dies, and whereby the forces required to move the workpiece laterally of said resilient material fall within the projectioned cross section of said dies.

16. A device for truing a wheel blank having a rim with opposing tire bead seats, said device comprising: a frame, a first set of inwardly movable dies carried by said frame for finish deforming one bead seat of a blank positioned inwardly of said dies, a second set of inwardly movable dies carried by said frame for finish deforming the other bead seat of a blank positioned inwardly of said dies, a first ring positioned outwardly of said first set of dies with one side portion of said ring being opposite said dies and the other side portion being opposite said frame, a second ring positioned outwardly of said second set of dies with one side portion of said ring being opposite said dies and the other side portion being opposite said frame, a first antifriction bearing accurately positioning said other side portion of said first ring from said frame, a second antifriction bearing accurately positioning said other side portion of said second ring from said frame, means causing rotation of said first and second rings to move respective first and second sets of dies inwardly independently of each other, and means for independently actuating said rings.

17. A device for truing a wheel blank having a rim with opposing tire bead seats, said device comprising: a frame, a first set of radially extending slides carried by said frame and having radially inner ends for abutment with one of the tire bead seats of a wheel positioned inwardly of said slides, a second set of radially extending slides carried by said frame and having radially inner ends for abutment with the other one of the tire bead seats of the wheel, a first ring positioned radially outwardly of said first set of slides with one side portion of said ring being opposite said slides and the other side portion being opposite said frame, a first antifriction bearing accurately positioning said other side of said first ring from said frame, a second ring positioned radially outwardly of said second set of slides with one side portion of said ring being opposite said slides and the other side portion being opposite said frame, a second antifriction bearing accurately positioning said other side of said second ring from said frame, first and second sets of toggles with the first set connecting said first ring and first set of slides and said second set of toggles connecting said second ring and second set of slides, said toggles being pinned to their rings on a circular centerline generally opposite the respective antifriction bearing, and means for rotating said first and second rings.

18. The device of claim 17 including: a workpiece support carried by said frame generally inwardly of said slides, said workpiece support being constructed and arranged to accommodate radial movement of a workpiece seated thereon relative to said frame, and means rotating said first and second rings sequentially, and whereby a workpiece positioned on said support is centered and held by the first set of dies and the second set of dies finishes the deformation of the workpiece corresponding to the deformed surface established by the first set of dies.

19. The device of claim 18 wherein said workpiece support has a surface sufficiently resilient to accommodate lateral truing of the rim of the wheel blank by said slides.

20. The device of claim 18 wherein said workpiece support has a surface sufficiently resilient to accommodate a lateral spreading action imparted to the bead seats of the wheel by a wedging action of said slides against the bead seats.

* * * * *